US006437750B1

(12) United States Patent
Grimes et al.

(10) Patent No.: US 6,437,750 B1
(45) Date of Patent: Aug. 20, 2002

(54) ELECTRICALLY-SMALL LOW Q RADIATOR STRUCTURE AND METHOD OF PRODUCING EM WAVES THEREWITH

(75) Inventors: Craig A. Grimes; Dale M. Grimes, both of Lexington, KY (US); Faton Tefiku, San Diego, CA (US); Gang Lui, Lexington, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 0 days.

(21) Appl. No.: 09/614,950

(22) Filed: Jul. 12, 2000

Related U.S. Application Data

(60) Provisional application No. 60/152,996, filed on Sep. 9, 1999.

(51) Int. Cl.[7] ..... H01Q 21/00; H01Q 9/16

(52) U.S. Cl. ..... 343/726; 343/793

(58) Field of Search ..... 343/726, 727, 343/728, 730, 793, 853, 855, 866, 893, 810, 823, 842; H01Q 21/00, 9/16

(56) References Cited

U.S. PATENT DOCUMENTS

| | | | | | |
|---|---|---|---|---|---|
| 2,465,379 | A | * | 3/1949 | Kandoian | 250/33.53 |
| 2,953,782 | A | * | 9/1960 | Byatt | 343/118 |
| 4,145,694 | A | * | 3/1979 | Sletten | 343/727 |
| 4,433,336 | A | * | 2/1984 | Carr | 343/728 |
| 4,746,867 | A | * | 5/1988 | Gunton | 324/329 |
| 4,809,009 | A | | 2/1989 | Grimes et al. | 343/726 |
| 5,300,885 | A | * | 4/1994 | Bull | 324/247 |
| 6,211,840 | B1 | * | 4/2001 | Wood et al. | 343/793 |
| 6,211,846 | B1 | * | 4/2001 | Gouin | 343/891 |

OTHER PUBLICATIONS

Grimes, D. M., and C. A. Grimes, "Bandwitdth and Q of Antennas Radiating TE and TM Modes," *IEEE Transactions on Electromagnetic Compatibility,* vol. 37, No. 2, pp. 217–226, May 1995.

Grimes, D. M., and C. A. Grimes, "Classical electrodynamics on an atomic scale: why a quantum theory of radiation is unnecessary," *Speculations in Science and Technology,* vol. 20, pp. 197–210, 1997.

(List continued on next page.)

*Primary Examiner*—Hoanganh Le
*Assistant Examiner*—Trinh Vo Dinh
(74) *Attorney, Agent, or Firm*—Macheledt Bates LLP

(57) ABSTRACT

An electrically small radiator structure for radiating electromagnetic waves having an electrical size, k*a, with a value less than $\pi/2$ and above $\pi/20{,}000$ and configured to have at least a first and second magnetic, or electric, dipole element. Dipole elements are preferably oriented such that a source-associated standing energy value for the structure, or $W_{ds}(t_R)$, is low, Radiative Q value preferably less than $\frac{1}{3}(k^*a)^3$; and each of the elements, whether paired with respective electric dipole elements, is in electrical communication through a feed circuit to at least one power source. Further, a first dipole pair (or element) oriented orthogonally with respect to a second pair (or element) are in voltage phase-quadrature; the structure is operational at a frequency below 5 GHz; and dipole moments oriented such that the following is generally satisfied: a divergence of the Poynting vector of the pairs with respect to retarded time, namely $\nabla|_{t_R}\cdot N$, has a value less than 1.0. Also, a method of producing electromagnetic waves using an electrically small radiator structure, including configuring the structure to have at least a first and second pair of dipole moments and an electrical size, k*a, with a value less than $\pi/2$ and above $\pi/20{,}000$; and powering a first feed area of the first pair and a second feed area of the second pair with at least one source operating at a frequency to radiate the waves.

27 Claims, 7 Drawing Sheets

OTHER PUBLICATIONS

Grimes, D. M., and C.A. Grimes, "Power in modal radiation fields: Limitations of the complex Poynting theorem and the potential for electrically small antennas," *Journal of Electromagnetic Waves Applications,* vol. 11, pp. 1721–1747, 1997.

C. T. A. Johnk, *Engineering Electromagnetic Fields and Waves,* John Wiley & Sons, Inc., New York, pp. 385–402 (chapter 7), 1988; general background information and explanatory figures on the theorem of Poynting—particularly the simplification of the complex Poynting for the time–average Poynting theorem.

C. T. A. Johnk, *Engineering Electromagnetic Fields and Waves,* (a) section 3–2, pp. 116–119 and pp. 195–196 on electric dipole moments and capacitance; (b) section 3–4, pp. 127–129 and pp. 273–274 on magnetic dipole moments; and (c) section 11–4, pp. 555–562 illustrating Radiation Fields of a Linear Center–fed Thin–wire Antenna including standing wave current distributions.

Young, Paul H., *Electronic Communication Techniques,* Macmillan Publishing Company, New York, pp. 639–643 (third edition), 1994.

Young, Paul H., *Electronic Communication Techniques,* Macmillan Publishing Company, New York, pp. 639–643 (third edition), 1994; included herewith for additional general background information and more–simplified explanatory figures on the Poynting vector and antenna structures (especially the dipole antenna).

* cited by examiner

Method of producing an electrically small, low Q radiator structure for operation at lower-frequencies

Method of producing EM waves with an electrically small, low Q radiator

ELECTRICALLY-SMALL LOW Q RADIATOR STRUCTURE AND METHOD OF PRODUCING EM WAVES THEREWITH

This application claims priority under 35 U.S.C. 119(e) and 37 C.F.R. §1.78 to Provisional Patent Application U.S. No. 60/152,996 filed Sep. 9, 1999.

The numerical and experimental portions of this work were supported in part by the United States Air Force Office of Scientific Research under contract F49620-96-1-0353. However no direct federal funds were used in the development of the techniques, methods and radiator structures disclosed herein at the time of invention. Accordingly, the U.S. Government may have certain rights in this invention.

BACKGROUND OF THE INVENTION

In general, the present invention relates to techniques for determining electrical size, as well as the physical design/structure and other characteristics, of electromagnetic (EM) radiation sources (or simply referred to as, antennas) that operate in a frequency range up to about 5 GHz. The novel technique and associated "electrically small" radiator structures described herein allow radiation/waves to be 'launched' as a generally directed beam and radiate away from the radiator source rather than remaining in proximity to the structure (as "standing energy") when operating. More particularly, the instant invention relates to electrically small, wideband radiator structures for radiating EM waves as well as a novel method of producing EM waves and associated novel techniques for producing novel electrically-small radiator/antenna designs, such that the source-associated standing energy, i.e. the energy that returns from the radiated field to the structure to affect operation, is minimal. According to the novel design technique of the invention, optimally the source-associated standing energy for a fully-optimized 'perfect' radiator structure of the invention (i.e., one that behaves identically as predicted by mathematical theory), would be zero. To produce designs having minimal source-associated standing energy, the technique of the invention incorporates the identification of a solution to generally satisfy a unique expression derived by the applicants hereof. This unique expression utilizes the time-dependent Poynting theorem (rather than the conventionally-used complex Poynting theorem, the frequency-domain solutions for which are missing important antenna phase information) and takes into account three numbers/expressions in specifying time-varying power of a radiating antenna structure rather than just two numbers/expressions, as has conventionally been done to create solutions using the complex Poynting theorem.

The application of the novel techniques of the invention leads to the design of novel radiator structures, each structure preferably having at least four dipole moments arranged as dipole pairs with an overall electrical size, k*a, with a value less than $\pi/2$. Each dipole pair is configured to have at least a magnetic dipole element, and preferably also an electric dipole moment, the dipole pairs oriented in such a way that: the divergence of the Poynting vector of the system of two pairs of dipole moments with respect to 'retarded time' is a small, or negligible value (and, in an optimal case, this divergence value is zero). Although considered electrically small, surprisingly these novel structures readily emit waves with longer wavelengths (such as are encountered in wireless communications, radar detection, microwave technology devices, and medical device technology) at lower frequencies (throughout the electromagnetic wave Radio Spectrum and below, generally targeting frequencies<5 GHz) as non-reciprocal, wideband devices.

The low frequency radiator structure designs of the invention, unlike any currently in use, can be sized with a relative electrical length smaller than $ka \approx \pi/2$, where the physical dimension "a" used throughout is that identified by Chu (1948), and indeed sized as small as $ka \approx \pi/2000$ (i.e., up to 1000 times smaller than any currently in operation); and such a structure may readily be configured up to 10,000 times smaller than any conventional antenna, or where $ka \approx \pi/20{,}000$. For further background reference, see Chu, L. J. Physical limitations of omni-directional antennas, *J. Appl. Phys.,* 19, 1163–1175, 1948, for an analysis of one-dimensional multipolar sources of only electric dipoles (TM) fields. In his research, Chu (1948) provided a physical interpretation of dimension a by constructing the smallest possible circumscribing sphere having a radius "a" that fully contained the radiating source to then calculate the integral of the complex Poynting vector over that surface. Traditional and current antenna design practices lead designers to build extremely long structures to emit electromagnetic waves at selected frequencies, for example, the dimension a of an electric dipole antenna that operates at a frequency of 1 MHz would be on the order of 150 meters, and a 1.0 GHz dipole antenna for wireless communications would be approximately 15 cm in length. Whereas, using the novel technique of the invention allows one to produce EM waves using novel radiator structures sized on the order of 0.150 m (at 1 MHz) and 0.015 cm (at 1 GHz) long, respectively.

The historical difficulty in directing scientific research toward the exploration of building low Q, electrically small antennae stems from the conventional use of frequency domain mathematics to describe operational performance. According to accepted definitions, reactive power in electrical circuits is in time quadrature with the real power and its magnitude is $2\omega$ times the energy that oscillates twice each field cycle between the source and the circuit, where $\omega$ is the radian frequency of the field. It is widely believed that this statement applies to power in radiation fields, differing only in that energy oscillation is between the source and the fields. It is commonly accepted that, for a closed volume in space, the real part of the surface integral of the complex Poynting theorem is equal to the time-average output power and the imaginary part is proportional to the difference between the time-average values of electric and magnetic energy within the volume. By way of review: The Poynting vector was defined long ago in the late-1800's in connection with the flow of electromagnetic power through a closed surface as $\mathbf{P} \equiv E \times H$ VA/m$^2$, or W/m$^2$; J. H. Poynting, "On the transfer of energy in the electromagnetic field," *Phil. Trans. Royal Society,* 175, 343, 1884. For further general background information and explanatory figures on the theorem of Poynting, particularly the simplification of the complex Poynting for the time-average Poynting theorem, see the reference C. T. A. Johnk, *Engineering Electromagnetic Fields and Waves,* John Wiley & Sons, Inc., New York, pp. 385–402 (chapter 7), 1988.

In their pursuit to more-closely study power in radiation fields in earlier work (see Grimes, D. M., and C. A. Grimes, "Power in modal radiation fields: Limitations of the complex Poynting theorem and the potential for electrically small antennas," *Journal of Electromagnetic Waves Applications,* vol. 11, pp. 1721–1747, 1997), two of the applicants hereof rigorously analyzed power in sinusoidal steady state radiation fields and identified that for certain antenna designs the conventional practice to define reactive power as the imaginary part of the surface integral of the complex Poynting vector (which allows for a more straight-forward calculation thereof) causes a loss of very important information about the radiation source's properties. The authors, Grimes and Grimes (1997) instead found that in order to find solutions that correspond better with what is actually happening in the fields around an antenna, use of the time-dependent Poynting theorem (TDPT) characterizes power in a sinusoidal field with three important values. In an effort to simplify notation within their mathematical expressions, Grimes and Grimes (1997) introduced the variable $t_r=t-\sigma/\omega$ (which they refer to simply as "retarded time" where: $\omega$=radian frequency, $\sigma$=kr, k=wave vector, and r=radial distance from source).

In their 1997 publication, applicants Grimes and Grimes point out a fatal flaw in the premises (particularly, the concept applied regarding power in a radiation field) on which commonly accepted proofs concerning the behavior of the radiative Q of a radiation source (antenna) have been conventionally based. More particularly, these commonly accepted proofs lead to the conclusion that, in the limit as the product k*a goes to zero, the radiative Q of a radiation source (e.g., an antenna) goes to infinity. It is well known, that the standing energy adjacent an imperfect conductor causes power loss through surface current on the conductor. From these commonly accepted proofs concerning the behavior of the radiative Q of a radiation source, convention has it that, as the product k*a decreases for a dipole antenna, the antenna acts less as a generator of EM radiation and more like an energy-storage device (such as a capacitor). Thus, the following relationship has been universally applied to the design analysis of dipole antennae: The radiation-field standing energy in proximity to the antenna structure varies as the inverse cube of k*a. And this has lead to the following prevailing accepted conventional design criteria for antennae: The product of the wave number k of the radiation (where $k=2\pi/\lambda$) and ½ of the largest physical dimension of the radiation source (or, a, the value Chu (1948) defined) can be no less than approximately $\pi/2$, and thus an operational antenna can be no smaller than $a=\lambda/4$ (i.e., no less than one-fourth of the wavelength being radiated by the antenna).

Radiative Q is commonly used in describing the energies associated with antennas. A more-detailed explanation of Radiative Q is set forth below. The identification of the flawed premises upon which conventional antenna design practices are based influenced the applicants hereof to further analyze known ways to calculate Q for a radiation source and develop a novel method of determining Q based upon the time-dependent Poynting theorem that incorporates three necessary power expressions to describe the source-associated standing energy (including the two expressions found within the complex Poynting theorem plus the modal phase angle). This, in-turn, led to the ingenious techniques and novel electrically small radiating structure designs and methods of the instant invention, which effectively radiate as multi-element EM sources with a k*a product less than $\pi/2$, unlike conventional EM sources currently in use.

The new electrically small radiator structures and method of producing an EM signal and generally-directed beam as described herein, are suitable in operation with a wide range of EM wave generation, phase shifting, power splitter, circulator, and oscilloscope equipment to produce such signals. In the spirit of the many radiator designs contemplated hereby, the innovative, simple, and effective radiator structures and methods are suitable for use in a variety of environments allowing the structures to be tailored and installed with relative ease into available equipment. None of the currently-available EM radiating systems take advantage of the novel techniques identified herein to produce multi-element radiator structures that can be incorporated along with micro-components into associated microcircuits, as will be further appreciated.

SUMMARY OF THE INVENTION

It is a primary object of this invention to provide a multi-element electrically small radiator structure for radiating electromagnetic waves. This structure having an electrical size, or k*a product, of preferably less than $\pi/2$ and greater than, say, $\pi/20{,}000$, and configured to have at least a first and second magnetic dipole element. Such a structure may further have two or more pairs of dipole moments, each pair comprising a magnetic and electric dipole moment. The pairs of dipole moments are preferably oriented such that the following is generally satisfied: a divergence of the Poynting vector of the pairs with respect to retarded time, namely $\nabla|_{t_R}\cdot N$, has a value less than 1.0. Further, the magnetic dipole moments of each pair are preferably oriented generally in parallel with a respective electrical dipole moment, with the dipole pairs oriented generally orthogonally with respect to each other. The voltage across each dipole pair is preferably in phase-quadrature, and the pairs can be separately fed using a single power source. It is a further object to provide a method of producing an electromagnetic signal, which can be a generally-directed EM beam, with an electrically small radiator structure such as any structure produced according to the novel technique of the invention.

Certain advantages of providing the new radiator structures and associated new methods, as described and supported hereby, include the following:

(a) The novel radiator structures and method allow for a generally directed beam of energy to be emitted from an electrically small structure, while minimizing the source-associated standing energy remaining in proximity to the structure, at lower frequencies (for example, 5 GHz and below).

(b) Versatility—The invention can be used for sending lower-frequency EM signals (in turn, having longer wavelengths) over great distances, if necessary, using relatively small, non-reciprocal transmit-devices operational in a wide range of environments and applications. For example: in wireless/cellular communications, for sending information gathered about an area (e.g., to study the ocean floor, in aircraft and submarine radar obstacle detection, and in ground penetrating radar applications), in medical applications (e.g. directed-beam heating/removal of tumors, malignant tissue, cysts, etc.), in automatic manufacturing processes (e.g., auto-sensory equipment to detect whether a component is properly oriented and detecting surface roughness), and so on.

(c) Simplicity of use—The simplified design technique of the invention can be used to design many different types of suitable specific 'electrically small' structures that efficiently operate at lower frequencies; the technique can be applied to a wide variety of elements able to effectively operate as electric-magnetic dipole pairs to generally satisfy design criteria specified herein. Furthermore, the new radiator structures and associated methods can be installed/hardwired/incorporated into, and readily operational with, existing radar, telecommunications, and product manufacturing equipment, plus inter-connected to existing computer systems (whether with UNIX-, LINUX-, WINDOWS®-WINDOWS NT®, DOS, or MACINTOSH®-based operating systems) with relative ease.

(d) Design Flexibility—Producing a radiator structure according to the invention using the novel design techniques/guidelines described herein, allows for fabrication of many different structures of a variety of shapes using many different suitable materials (depending upon the environment in which the antenna structure of the invention is intended to operate); including i) a compound antenna structure composed of two pairs of loop-wire structures (these two structures preferably electrically-insulated by suitable means, such as providing a spacing or coating the structure at a potential point of contact with a dielectric material), ii) microelectronic conductive elements oriented and fabricated according to well known microcircuit fabrication techniques such that the divergence of the Poynting vector of the system of two pairs of dipole moments with respect to 'retarded time' is small or negligible, iii) a membrane filled with a conductive gel-substance/plasma and a voltage source therewithin such that the divergence of the Poynting vector of the system with respect to 'retarded time' is small or negligible.

(e) Applications—The novel use of the time-dependent Poynting theorem to analyze the operation of electrically small antenna structures at lower-frequencies, after identifying flaws in current design practices, in concert. with using newly-identified conditions, give antenna design engineers not only a valuable novel technique of producing electrically small antennas but also a tool box full of new design structures for operation at lower-frequencies.

(f) Beam Directivity and Performance of an Array of Structures—The novel technique for producing electrically small low Q antennas, the radiator structures produced thereby, as well as the method of producing an EM signal, are applicable to arrays of low Q radiator structures constructed according to the invention and arranged according to known antenna array factors to produce a system with a highly directed beam.

Briefly described, once again, the invention includes an electrically small radiator structure for radiating electromagnetic waves. The structure has an electrical size, k*a, with a value between $\pi/20{,}000$ and $\pi/2$ and is configured to have at least a first and second magnetic dipole element. Further distinguishing features of the invention: The dipole elements are preferably oriented such that a source-associated standing energy value for the structure, or $W_{dS}(t_R)$, is low, and each of the elements is in communication through a feed circuit to at least one power source. A structure of the invention can be constructed such that a Radiative Q value therefor will generally be less than $\frac{1}{3}(k^*a)^3$. The structure can have first and second dipole pairs, each comprising an electric dipole element and a magnetic dipole element; both pairs can be connected through a feed circuit to at least one power source. The dipole pairs are preferably generally electrically-insulated from each other. Further distinguishable, the first pair is preferably oriented orthogonally with respect to the second pair, a voltage across the first pair and a voltage across the second pair are in phase-quadrature with a radiated power from each pair being generally balanced, and the multi-element structure is operational at a frequency below 5 GHz. According to novel design techniques of the invention, the pairs of dipole moments can be oriented such that the following is generally satisfied: a divergence of the Poynting vector of the pairs with respect to retarded time, namely $\nabla|_{t_R}\cdot N$, has a value less than 1.0.

Also characterized herein is a method of producing electromagnetic waves using an electrically small radiator structure. The method comprises configuring the structure to have at least a first and second pair of dipole moments and an electrical size, k*a, with a value between $\pi/20{,}000$ and $\pi/2$; and powering a first feed area of the first pair and a second feed area of the second pair with at least one source operating at a frequency to radiate the waves. Features that further distinguish the invention from conventional methods: Forming a first elongated member into the first pair which includes a magnetic and electric dipole element and forming a second elongated member into the second pair which also includes a magnetic and electric dipole element, and electrically insulating the dipole pairs; orienting the pairs such that the following is generally satisfied: a divergence of the Poynting vector of the pairs with respect to retarded time, namely $\nabla|_{t_R}\cdot N$, has a value less than 1.0; orienting the pairs such that (a) a dipole moment axis of the first electric dipole element is generally in parallel with a dipole moment axis of the first magnetic dipole element, (b) a dipole moment axis of the second electric dipole element is generally in parallel with a dipole moment axis of the second magnetic dipole element, and (c) the first pair is orthogonal with respect to the second pair; and generating electromagnetic energy with a single source and passing it through a feed circuit electrically connected to a first feed area of the first pair and a second feed area of the second pair.

BRIEF DESCRIPTION OF THE DRAWINGS

For purposes of illustrating the innovative nature plus the flexibility of design and versatility of the preferred radiator structures and associated methods, the invention will be better appreciated by reviewing any accompanying drawings of the invention (in which like numerals, if included, designate like parts). The figures have been included by way of example, only, and are in no way intended to unduly limit the disclosure hereof.

(FIG. 1A) in phase and phased to support circular polarization (i.e., in phase-quadrature); again, electrical size, k*a product, equal to 0.42.

DETAILED DESCRIPTION OF THE PREFERRED EMBODIMENTS

Figure 1A:
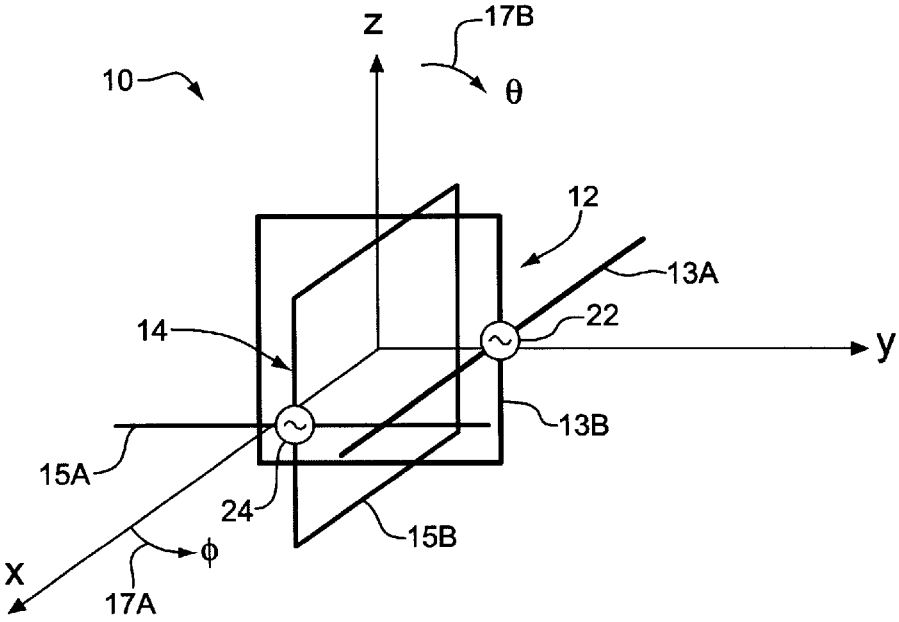
FIG. 1A is a schematic of a preferred radiator structure comprised of two pairs of dipole elements oriented in a turnstile shape, each pair provides a magnetic and electric dipole moment.

The following papers [1], [3], [5] and [6] authored by the applicants hereof while owing an obligation of assignment to the assignee hereof; and background items [2], [4] and [7], are included for background purposes.

[1] Grimes, D. M., and C.A. Grimes, "Power in modal radiation fields: Limitations of the complex Poynting theorem and the potential for electrically small antennas," *Journal of Electromagnetic Waves Applications,* vol. 11, pp. 1721–1747, 1997.

[2] C. T. A. Johnk, *Engineering Electromagnetic Fields and Waves,* John Wiley & Sons, Inc., New York, pp. 385–402 (chapter 7), 1988; general background information and explanatory figures on the theorem of Poynting—particularly the simplification of the complex Poynting for the time-average Poynting theorem.

[3] Grimes, D. M. and C.A. Grimes, "Radiation Q of dipole-generated fields", *Radio Science,* vol. 34, no. 2, pp. 281–296, March–April 1999.

[4] C. T. A. Johnk, *Engineering Electromagnetic Fields and Waves,* (a) section 3-2, pp. 116–119 and pp. 195–196 on electric dipole moments and capacitance; (b) section 3-4, pp. 127–129 and pp. 273–274 on magnetic dipole moments; and (c) section 11-4, pp. 555–562 illustrating Radiation Fields of a Linear Center-fed Thin-wire Antenna including standing wave current distributions.

[5] Gang Liu, C. A. Grimes, and D. M. Grimes, "A Time-domain Technique for Determining Antenna Q", *Microwave and Optical Technology Letters,* vol. 21, no. 6, Jun. 20, 1999.

[6] Faton Tefiku and C. A. Grimes, "Coupling Between Elements of Electrically Small Compound Antennas", *Microwave and Optical Technology Letters,* vol. 22, no. 1, Jul. 5, 1999—includes general use of compound dipole antennas.

[7] Young, Paul H., *Electronic Communication Techniques,* Macmillan Publishing Company, New York, pp. 639–643 (third edition), 1994.

The focus of the innovative techniques described herein, is on radiative structure designs having at least two dipole moment pairs, each with at least one electric dipole and one magnetic dipole oriented in such a fashion that targets satisfying the following unique expression: The divergence at the traveling point is equal to the negative of the rate at which energy per unit volume separates from the wave at each point in four space:

$$\nabla|_{t_R} \cdot N + \frac{\partial W_{dS}(t_R)}{\partial t_R} = 0 \qquad \text{Eq. (1)}$$

The collaborators have identified that since the second term in Eq. (1), namely the time-derivative of the source-associated standing energy, is optimally zero, to satisfy Eq. (1) the remaining term, namely the divergence of the Poynting vector with respect to retarded time, must be set equal to zero. Since the system, including the antenna and the surrounding region in which it will operate, is imperfect and therefore the antenna will have negligible (rather than none) source-associated standing energy, the divergence of the Poynting vector with respect to retarded time will, necessarily be equal to some small or negligible value for an operating structure of the invention (as supported by data collected for Radiation Q taken from tests of the embodiment shown in FIG. 1A). As can be appreciated from the discussion herein, there are many radiator structures, sized smaller than $k^*a \approx \pi/2$ and indeed sized as small as $k^*a \approx \pi/20{,}000$ as mentioned, that generally satisfy this condition. For all practical purposes, no region is purely 'lossless' and there are material imperfections in all conductive structures, albeit these can be minimized by proper design and fabrication. Nevertheless, the coherent interaction of the standing energy fields of two pairs of dipole moments (each pair having an electric and a magnetic dipole moment) as produced according to the novel design technique of the invention with field symmetry of the two pairs preserved to cancel individual standing energies, optimally leads to a minimization of the standing energy of the radiator structure as a whole.

A full explanation and derivation of the novel expression Eq. (1) can also be found on page 287 of Grimes and Grimes 1999 listed as [3] above, and numbered Eq. (33) therein. Note that, although a rigorous derivation of the very unique Eq. (33) was made by applicant-authors Grimes and Grimes 1999 in their *Radio Science* article [3], no mention was made therein that electrically small antenna/source structure designs can be optimized to produce a generally directed beam whereby source-associated standing energy of the antenna, and thus its Radiation Q, is negligible (and preferably zero) for structures having a physical dimension $k^*a < \pi/2$.

This means that an electrically small radiator structure of the invention, in operation, can launch a beam of EM radiation/energy (or, EM wave) that is directed away from the structure with very little, and in a purely lossless case no, standing energy 'stuck' near the structure. By way of comparison on the other end of the spectrum is a 'perfect capacitor' which has a divergence $\nabla|_{t_R} \cdot N$, see Eq. (1) herein, with a value going to infinity, since theoretically all of the conductive structure's standing energy stays with the perfect capacitor allowing none to 'escape' (energy is not radiated outwardly but maintained in and about the capacitor-structure).

A radiator structure of the invention preferably has an electrical, size, namely its k*a product (where $k=2\pi/\lambda$ is the wave number in free space), that is less than $\pi/2$ and can operate at low frequencies: after substitutions, electrical size $(k^*a)=2\pi\cdot(a/\lambda)$, where $\lambda$ is the wavelength emitted.

By the theoretical analyses detailed in Grimes and Grimes *Radio Science* (1999) and Chu (1948) when the two dipoles of a turnstile antenna structure such as that shown in FIG. 1A are driven with voltages across each pair are in phase, the resulting Radiative Q is that of a single electric dipole, given by:

$$Q = \frac{1}{2(ka)^3}\left(1 + \sqrt{1 + 4(ka)^4}\right) + \frac{1}{(ka)} \cong \frac{1}{(ka)^3} + \frac{1}{(ka)} \qquad \text{Eq. (2)}$$

Where 2a is the length of the radiator structure, $k=2\pi/\lambda$ (also referred to as "wavevector"), and the product k*a denotes the relative electrical size of the radiator structure.

Figure 2:
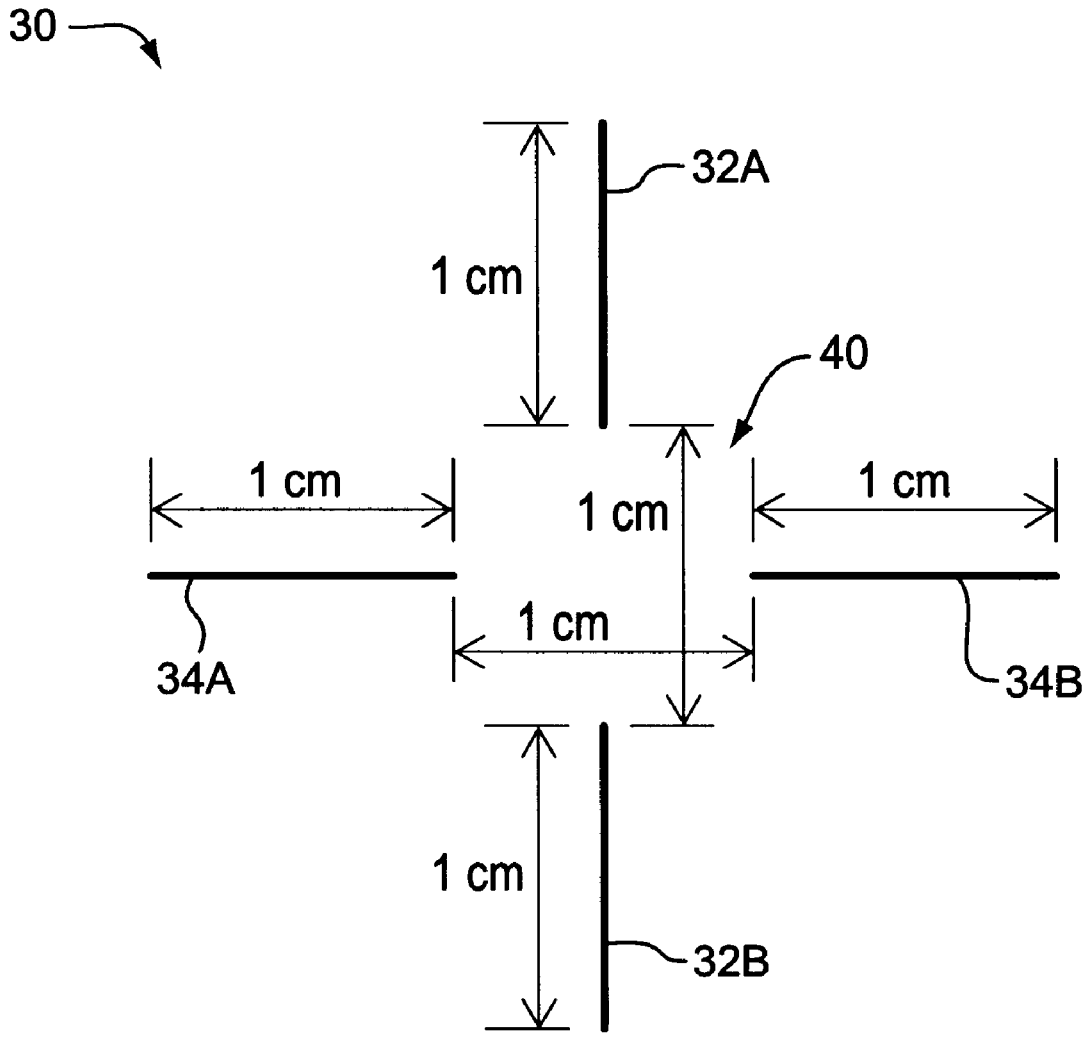
FIG. 2 is a schematic of alternative radiator structure of the invention depicted as a turnstile comprising two electric dipole elements orthogonally oriented.

For the two element turnstile antenna structure such as that in FIG. 2, the analyses of Chu (1948) predicts a Q value given by Eq. (2) independent of relative phasing between the two dipoles. However by further analysis as detailed by applicants Grimes and Grimes, *Radio Science* (1999) and incorporated herein, relative phasing has been found to alter Radiative Q of the antenna structure. When the two dipoles are driven in phase-quadrature, the Radiative Q is:

$$Q = \frac{1}{3(ka)^3} + \frac{1}{(ka)} \qquad \text{Eq. (3)}$$

By comparing Eqs. (3) and (2), note the factor of one-third difference in Radiative Q due to a relative 90° voltage phase difference between dipole pairs, i.e. phased to support circular polarization, in the electrically small limit. Thus, Eq. (3) governs the simple multi-element structure as configured in FIG. 2 having orthogonally oriented electric dipole elements driven in phase-quadrature.

The numerical technique of the invention begins with a definition updated by applicants, for Radiative/Radiation Q of an antenna structure:

$$Q = \frac{\omega W_{Spk}}{P} \qquad \text{Eq. (4)}$$

$W_{Spk}$ denotes the peak standing field energy that remains attached to the source structure, ω the radian frequency, and P is the time average (real) output power. Time average output power, P, can be obtained by integrating over a virtual sphere that circumscribes the source structure. The historical difficulty with calculating Radiative Q is determining which part of the total field energy remains associated with, or stuck near, the antenna structure affecting performance and which part does not. In order to characterize a radiative source structure containing at least one dipole, once the source reaches steady state the power driving the structure is turned off. This causes the local standing energy field to collapse, with the source-associated standing energy returning to the source structure from which, in turn, it is either reflected back into space or dissipated in a resistor electrically connected to the source structure.

Here, the analytic method for determining Radiative Q is summarized: Starting with the time dependent Poynting vector, N (bold face-type indicates a vector), the power that separates from the outgoing EM wave is calculated using the divergence of the power at constant retarded time $t_R=t-\sigma/\omega$, where t denotes time, ω the radian frequency, σ=kr, and r the radial distance from the source. The divergence at constant retarded time is set equal to the rate at which energy is extracted from the wave at each point in four-space. An indefinite time integral of the result and the addition of the appropriate integration constant results in the source associated standing energy density, $W_{dS}(t_R)$, where subscript "d" indicates density and "S" indicates source associated. The integration constant can then be chosen in such a way that it is both part of the total energy density, $W_{dT}(t_R)=\in/2E\cdot E+\mu/2H\cdot H$ and the smallest possible value for which $W_{dS}(t_R)\geqq 0$ at all points in four-space. Accordingly then, to find the peak source-associated standing energy $W_{Spk}$: {1} Determine the time dependent Poynting vector N for the radiation source; {2} Evaluate the divergence of N at constant retarded time; {3} Take the indefinite integral of this divergence with respect to retarded time to obtain the time varying portion of the source-associated standing energy density; {4} Insert the smallest integration constant for which the source associated standing energy is positive at all points in four-space; and finally, {5} Take the definite integral of the time dependent source-associated standing energy density over external space to obtain $W_S(t_R)$, to obtain the peak value $W_{Spk}$.

Note, here, that analytic/numerical techniques used to determine the Radiation Q of an EM radiation source necessarily, due to the conventions employed, solve for the fields external to a virtual sphere enclosing the source structure, and therefore ignore standing energy at radii less than the length of the arms of the antenna structure. Hence the analytic expressions for Radiative/Radiation Q are inherently optimistic, in that actual Radiative Q values will be higher due to standing energy within the antenna arm radius.

The following describes an application of the analytic technique of the invention to a spherical source structure consisting of, for example, four coherently radiating dipoles as shown in FIG. 1A. Two special cases are examined, here: Case (A) All four dipoles are driven in-phase. Case (B) The four dipole elements are divided into two dipole pairs, each pair is comprised of an electric dipole and a magnetic dipole element driven in phase; the two dipole pairs, oriented as shown in Figure 1A, are driven in phase quadrature (±90°). For reference, the source associated standing energy density for Case (A) is:

$$W_{dS}(t_R) = \frac{\varepsilon}{2}\left\{\begin{array}{c} 4\left\{\frac{1}{\sigma^6}[1-\cos(2\omega t_R)] + \frac{2}{\sigma^5}\sin(2\omega t_R) + \frac{1}{\sigma^4}[1+\cos(2\omega t_R)]\right\}\sin^2\theta + \\ \frac{1}{\sigma^6}[1-\cos(2\omega t_R)](1+\cos^2\theta) \end{array}\right\} \qquad \text{Eq. (5)}$$

Integrating Eq. (5) over all space, it follows that the total source associated standing energy is:

$$W_S(t_R) = \frac{8\pi\varepsilon}{3k^3}\left\{\frac{1}{(ka)^3}[1-\cos(2\omega t_R)] + \frac{2}{(ka)^2}\sin(2\omega t_R) + \frac{2}{(ka)}[1+\cos(2\omega t_R)]\right\} \qquad \text{Eq. (6)}$$

The outbound real power is, then:

$$p(t_R) = \frac{8\pi}{3\eta k^2}\left\{[1-\cos(2\omega t_R)] - \left(\frac{2}{(ka)} - \frac{1}{(ka)^3}\right)\sin(2\omega t_R) + \frac{2}{(ka)^2}\cos(2\omega t_R)\right\} \quad \text{Eq. (7)}$$

Combining Eqs. (4), (6) and (7) the Radiative/Radiation Q of the source structure for Case (A) results in the expression:

$$Q = \frac{\omega W_{Spk}}{P_{av}} = \frac{1}{2(ka)^3}\left(1+\sqrt{1+4(ka)^4}\right) + \frac{1}{(ka)} \quad \text{Eq. (8)}$$

where a is the radius of the source structure. Thus, for an electrically small antenna the Radiation Q of Case (A) is approximately the same as that of a single electric dipole, see Eq. (2).

Application of the analytic technique of the invention to the phase-quadrature Case (B), leads to the following mathematical relationships for radiation properties:

$$W_{dT}(t_R) = \frac{\varepsilon}{2}\left\{\frac{2}{\sigma^2}(1+\cos^2\theta) + \frac{4}{\sigma^4}\sin^2\theta + \frac{1}{\sigma^6}(2+3\sin^2\theta)\right\} \quad \text{Eq. (9)}$$

$$N_r(t_R) = \frac{1}{\eta}\left[\frac{1}{\sigma^2}(1+\cos^2\theta) - \left(\frac{1}{\sigma^2}+\frac{1}{\sigma^6}\right)\cos\theta\right] \quad \text{Eq. (10)}$$

$$N_\theta(t_R) = -\frac{2}{\eta\sigma^5}\sin\theta \quad \text{Eq. (11)}$$

$$N_\phi(t_R) = \frac{2}{\eta}\left[\left(\frac{1}{\sigma^3}+\frac{1}{\sigma^5}\right) - \frac{1}{\sigma^3}\cos\theta\right]\sin\theta \quad \text{Eq. (12)}$$

$$W_S(t_R)=0 \quad \text{Eq. (13)}$$

$$P(t_R) = \frac{16\pi}{3\eta k^2} \quad \text{Eq. (14)}$$

$$Q=0 \quad \text{Eq. (15)}$$

Thus, the calculated source associated standing energy, and, the resulting Radiative/Radiation Q, are zero for Case (B). Keeping in mind that this zero Q result is obtained using ideal, spherical mathematical functions the result motivated both a numerical and experimental follow up investigation to identify and confirm structures of a low Radiative Q, electrically small antenna.

Figure 1B:
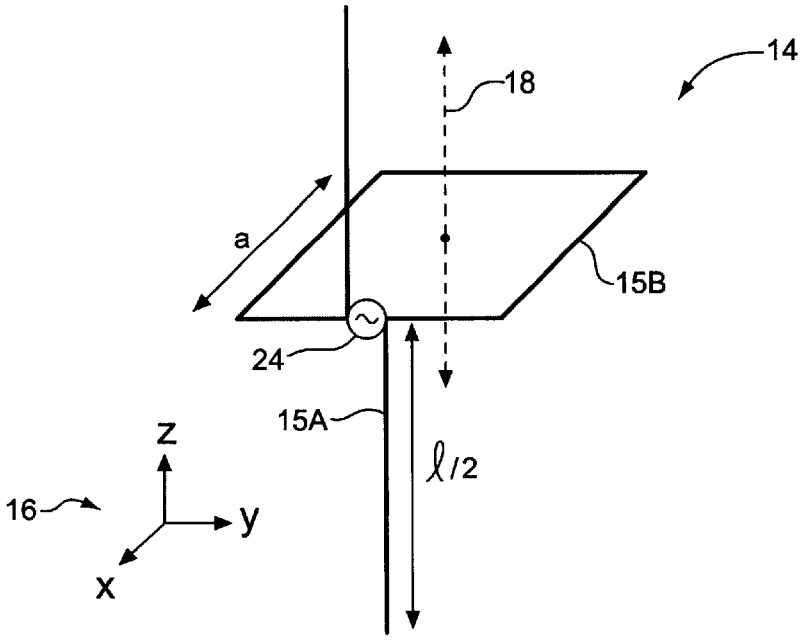
FIG. 1B is a schematic of a single dipole pair similar to those shown in FIG. 1A, each pair has a looped magnetic dipole element and an electric dipole element with a single feed area—thickness of pair 12 is greater than that of pair 14 for purposes of illustrating the separate dipole pairs, only.

It is commonly accepted that the radiation source structure for a TM (electric) dipole mode is a short center-fed straight line conductive element, and the source structure for a TE (magnetic) dipole mode a small loop shape conductive element. To produce parallel oriented combined $TM_{01}$ and $TE_{01}$ modes, it is further known to employ a compound (or multi-element) antenna consisting of a short line element and a square loop element oriented as illustrated in FIG. 1B with a z-axis directed dipole and square loop in the x-y plane. Here, since the properties of an electrically small loop antenna depend by-and-large on the circumscribed area and not the particular shape of the loop, properties of an ES square looped structure are presumed to be the same as those of an ES circular looped structure. Further, for electrically small, constant current circular loop antennae, here the electromagnetic field components of the looped TE dipole element are approximated such that the TE dipole moment is normal to the plane of the loop element.

In compound (multi-element) antennas with TE and TM dipoles, it is known that the TE and TM dipole pairs must be configured and fed to radiate equal powers for optimum performance. This condition can be numerically represented by setting equal, the powers radiated by the line and loop, or $P_D=\frac{1}{2}R_D I_D^2$ and $P_L=\frac{1}{2}R_L I_L^2$, respectively. Therefore, for reference, in order for a line and a loop to radiate equal powers (such that the power radiating from each TE/TM pair is balanced) the resulting current amplitude ratio, A, will be:

$$A = \frac{I_L}{I_D} = \sqrt{\frac{R_D}{R_L}} = \frac{L_D}{kS} = \frac{\frac{L_D}{\lambda_0}}{2\pi\left(\frac{d}{\lambda_0}\right)^2} \quad \text{Eq. (16)}$$

while polarization of the compound structure depends on the relative phases of the dipole pairs. For the line and loop antenna pairs used in this example, for example configured as in FIG. 1B, the theoretical value for the ratio Eq. (16) is found to be A=5.093 after substitutions. For this condition of balanced power of the dipole pairs, the reactive or stored power theoretically derived from the radial component of complex Poynting vector when dipole pairs are in phase-quadrature is zero.

Returning, again, to the compound radiator structure 10 in FIG. 1A and dipole pair 14 thereof shown in FIG. 1B, one can see that the pair of elements 12 (which has a greater thickness than pair 14 for purposes of identification) is oriented orthogonally with respect to pair 14, resulting in respective magnetic square loop elements 13B, 15B orthogonally oriented and, likewise, respective electric line elements 13A, 15A orthogonally oriented with respect to each other. Reference coordinates have been included such that the angle labeled $\phi$ describes an angle in the x-y plane moving from the x-axis and angle $\theta$ is referenced from the z-axis in the z-y plane. Separate feed areas 22, 24 of respective dipole pairs 12, 14 can readily be powered from a single power source (such as the waveform generator in FIG. 4 at 75) through a feed circuit including a phase shifter (77 in FIG. 4) to provide voltage phase quadrature across the two pairs 12, 14. Although dipole pairs 12 and 14 of structure 10 appear to be in electrical contact at two points along loops 13B and 15B, preferably the pairs are electrically insulated by suitable means, such as coating potential contact points of each loop with insulative material or slightly offsetting the pairs 12, 14 (for example, in the z-axis direction such that the loop portions 13B, 15B are not in contact—see discussion of $D_z$ below in connection with FIG. 7). Reducing the number of power sources on which the radiator structure must depend to operate, reduces the possibility of unwanted interference due to any extra power sources.

FIG. 1B illustrates element 14 rotated 90° to have its line TM element (length, l) directed along the z-axis and a square loop TE element (dimension a on a side) oriented in the x-y plane as referenced by coordinates at 16. Pair 14 may be configured by forming, using suitable known means, the loop 15B between end-portions of a conductive elongated line such that the end-portions become the two z-axis directed arms of the electric dipole element 15A. Any suitable conductive material capable of producing the dipole moments may be used to construct a preferred radiator structure of the invention. The axis for loop element 15B is a labeled dashed line 18, which also represents the location of the magnetic moment produced by loop element 15B. Although more difficult to construct with a single conductive elongated member, line element 15A is preferably collocated as close as possible to, or along, dashed line axis 18 for more optimal antenna performance.

Further illustrating the flexibility of the invention, an alternative turnstile-type structure comprised of two center-fed orthogonally oriented line elements is shown at 30 in FIG. 2. Although shown as line TM dipole elements, the TM elements could be replace with an alternative structure of two orthogonally oriented TE (magnetic) elements. Although not specifically illustrated in FIG. 2, the radiator structure 30 can be fed from two separate feed areas labeled at 40, one to feed the electric dipole comprised of arms 32A, 32B and the other to feed electric dipole comprised of arms 34A, 34B. Many different alternative radiator structures having a wide variety of dipole shapes built of many different suitable materials (selected for the intended environment in which the radiator structure will operate) can be employed, including the following i) dipole structures formed of one or more elongated members and electrically-insulated by suitable means; ii) microelectronic conductive elements fabricated according to well known microcircuit fabrication techniques such that the structure of dipole moments are oriented to meet radiating specifications; iii) a membrane filled with a conductive gel-like substance or plasma with a voltage source located within such that the divergence of the Poynting vector of the system with respect to 'retarded time' is small or negligible; and so on.

Figure 3:
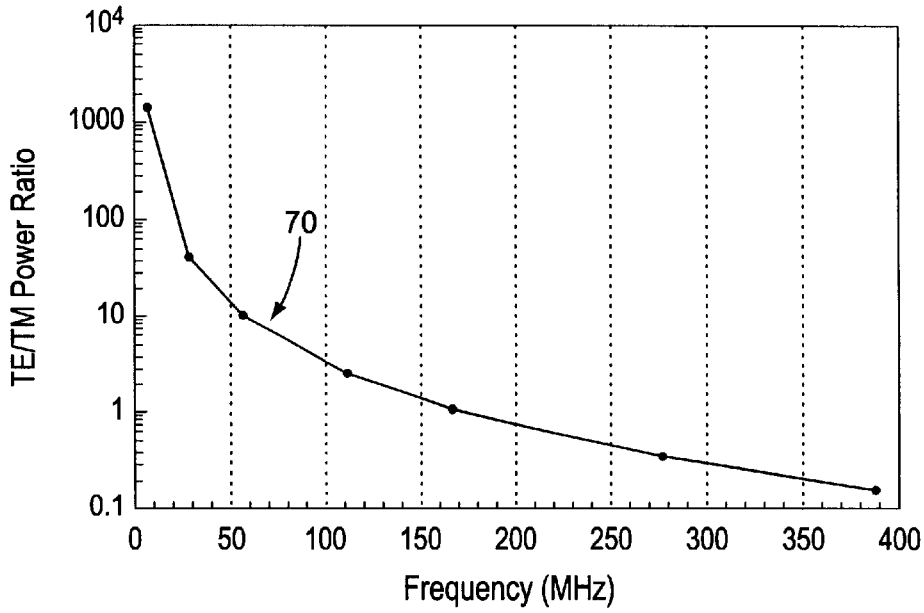
FIG. 3 is a graphical representation of TE/TM power ratio against frequency of waveform generated for a single dipole pair constructed as shown in FIG. 1B with the dimension: a=l/2=12 cm (by way of example, only).

Characterization of the dipole pair structure 14 of FIG. 1B led to results represented graphically at 70 in FIG. 3 whereby the calculated TE/TM power ratio has been plotted for the structure with loop sides a=l/2=12 cm. It is preferred that each dipole pair 12, 14 have individual TE and TM dipole elements that radiate equal TE and TM power. The fields on the surface of the smallest virtual sphere that circumscribes the radiating elements were computed for FIG. 3, using NEC4 MoM. Then, the calculated fields were equated to the multipolar field expansion to determine the TM dipole field coefficient F and the TE dipole field coefficient G. As is known, the TE to TM dipole power ratio is equal to $(G/F)^2$. As indicated by FIG. 3, the element radiates equal TE and TM power at 166.67 MHz. Where dimensions of the structure scale linearly with frequency for loop side a=l/2=4 cm, which is the case here, the equal power frequency is 500 MHz.

Figure 4:
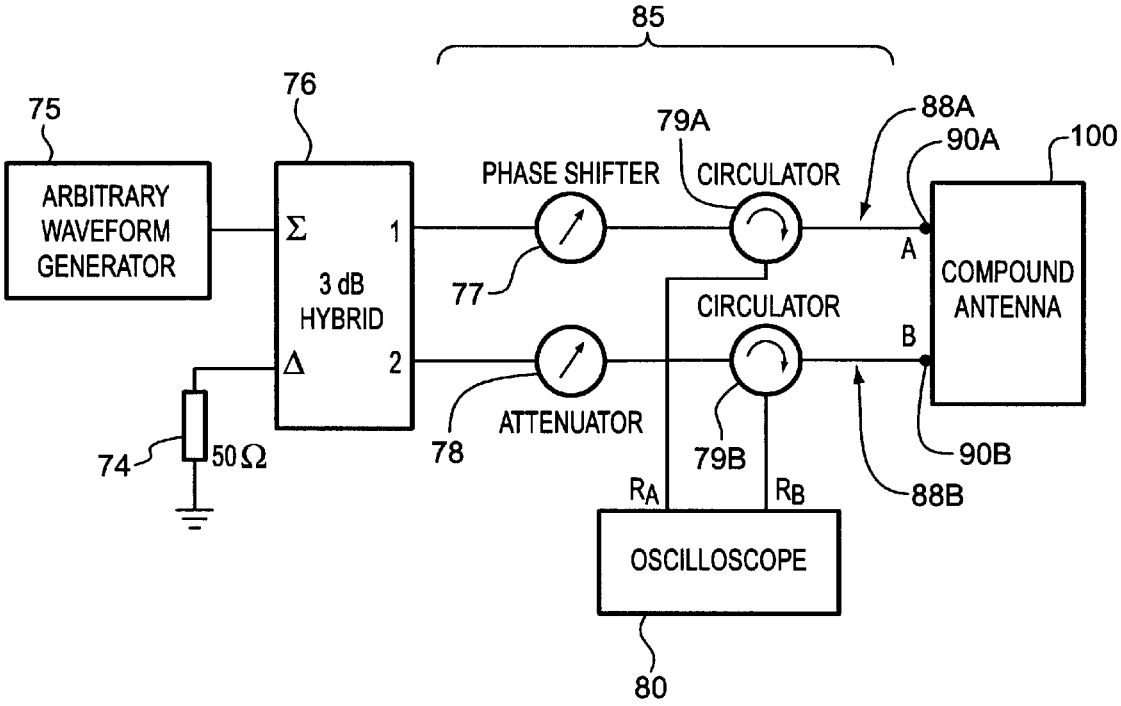
FIG. 4 schematically represents components of a system for driving a radiator structure of the invention to produce EM waves. Such a set up may also be used for gathering performance information and measurement data for a radiator structure of the invention.

In order to find the total source-associated standing energy of a dipole structure of the invention, the numerical method described in detail above in connection with Eqs. (4) and (5) for determining Radiative Q of such a structure can be employed. As stated above, after source voltage turn-off the time integral of the power absorbed in the voltage feed resistor and the time integral of the power reflected from the antenna structure back into space are summed. The sum is put equal to the source-associated standing energy. Use of the finite difference time domain (FDTD) technique to determine Q avoids spurious errors due to unwanted power reflections associated with feed networks, allowing for direct characterization of the antenna structure itself. This is important for an antenna structure 100 comprised, for example, of two radiating dipole pairs driven by a single generator 75 through a power splitter 76 and feed network 85, as illustrated in FIG. 4. When a 90° voltage phase shift (difference) is introduced between the two dipole pairs, an operating point of interest, the waves reflected back from the two dipole pairs to generator 75 are 180° out of phase and cancel with the forward traveling wave. Zero reflected power is measured independently of antenna properties. Consequently, use of the time domain method of determining Radiation Q allows for characterization of antenna performance independently of transmission line effects.

By way of example only, FDTD computations were made using a rectangular, three-dimensional computer code based on the known Yee (1966) cell. The problem space was chosen as 120×120×120 cells, with cell dimension $\Delta x=\Delta y=\Delta z=5$ mm; a matched absorbing boundary layer was used to terminate the computational space. Two dipole pairs, configured as in FIG. 1B comprising a square loop magnetic dipole element and a short wire electric dipole element, were fed with a sinusoidal wave of frequency f. For the numerical computations, the dimensions of the antenna structure were held constant at loop side length a=12 cm and electric dipole length l=24 cm. The operational frequency was varied above and below 166.67 MHz, which as mentioned above, is the frequency at which the TE and TM powers are of equal magnitude.

To drive a preferred antenna structure, as well as experimentally determine its Radiative Q, a network of components such as that shown in FIG. 4 may be used, including a circulator 79A, 79B placed within the feed line 88A, 88B of each dipole pair of the compound structure 100. After steady state operation is reached the waveform generator 75 was turned off and the power returned to each dipole pair of structure 100 captured from the output of the circulators 79A, 79B and measured using a two-channel oscilloscope 80. The returned power from each dipole pair can then be integrated over time and those quantities summed. This total returned power quantity was set equal to the source-associated standing energy. The output real power P is determined using a network analysis of the feed system. Just as with the numerical analysis, the experimental Radiative Q measurement technique identified likewise isolates radiator structure performance from its associated feed network enabling direct characterization of the antenna structure.

By way of example only to experimentally characterize a radiator. structure of the invention which was tested in an anechoic chamber, a waveform generator 75, the TEKTRONIX model AWG610™, was used. The TEKTRONIX AWG610™ is able to generate an arbitrary waveform to 500 MHz, and terminate the waveform virtually without a measurable transient. The generator output power in steady state can be determined from the measured voltage and was calculated to be about 7.1 mW (8.5 dBm). The circulators 79A, 79B as used effectively divide the input and reflected signals, so the generator 75 sees the network as a 50Ω load and delivers the same power as calculated above. As shown, a 3 dB hybrid power splitter 76 is used to split the power between the two dipole pairs of structure 100, a phase shifter 77 adjusts the desired voltage phase difference of the dipole pairs, an attenuator 78 compensates for any energy loss due to (within) phase shifter 77, and as mentioned the circulators 79A, 79B separate the incoming and reflected signals over network lines. To capture the transient signal coming back from the dipole pairs upon generator shutdown an 8 Giga-Sample/second HP 54845A™ oscilloscope was used. Using network theory the power radiated by the antenna structure was determined by taking into account any parasitic coupling between the two dipole pairs. The total source-associated standing energy of the antenna structure can then be determined by summing the time integrals of reflected powers from each dipole pair.

Figure 5:
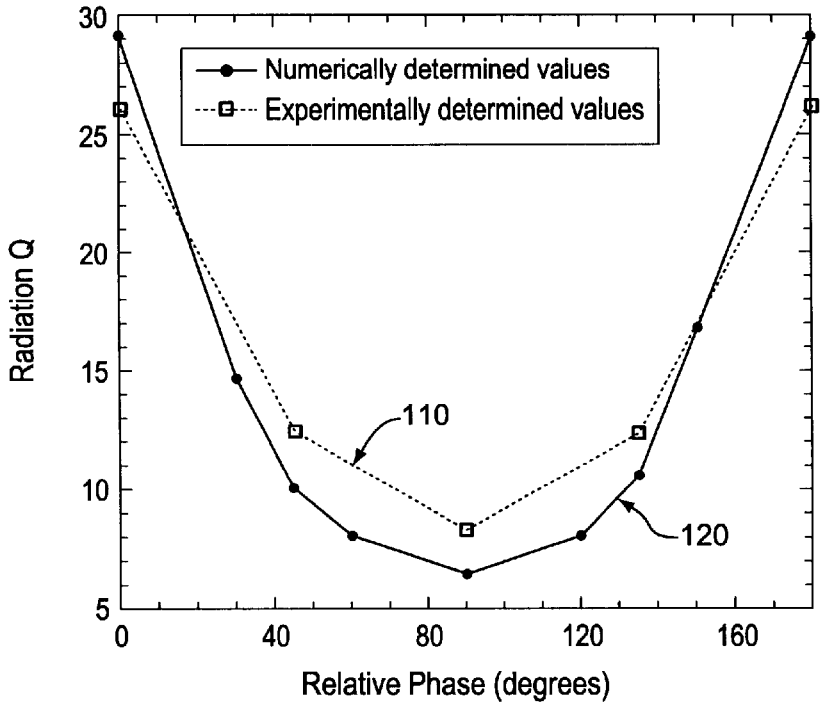
FIG. 5 has two graphical representations of Radiative Q as a function of relative phase between the voltage across a dipole pair such as that at 12 (FIG. 1A) and the voltage across a dipole pair such as that at 14 (FIG. 1A), with electrical size, k*a product, equal to 0.42. One graphical representation is for numerically determined values and the other is made with experimentally determined values.

FIG. 5 shows graphical representations of the numerically 120 and experimentally 110 determined Radiation Q of a preferred radiator structure at k*a=0.42 as a function of the phase difference between dipole pairs (x-axis). As predicted, these results show that the Radiation Q is dependent upon relative phasing between the two dipole pairs: When the dipole pairs are in phase Radiation Q is approximately that of a single electric dipole of the same electrical size; and when the dipole-pairs support circular polarization (or, 90° out of phase) Radiation Q is reduced by an approximate factor of 4.5 from the in-phase results. One can see that for the relative electrical size k*a=0.42 of the instant example structure, the measured Q value is approximately a factor of three below the minimum Q value predicted and determined by Chu (1948) for an omnidirectional antenna with the same k*a value.

Figure 6:
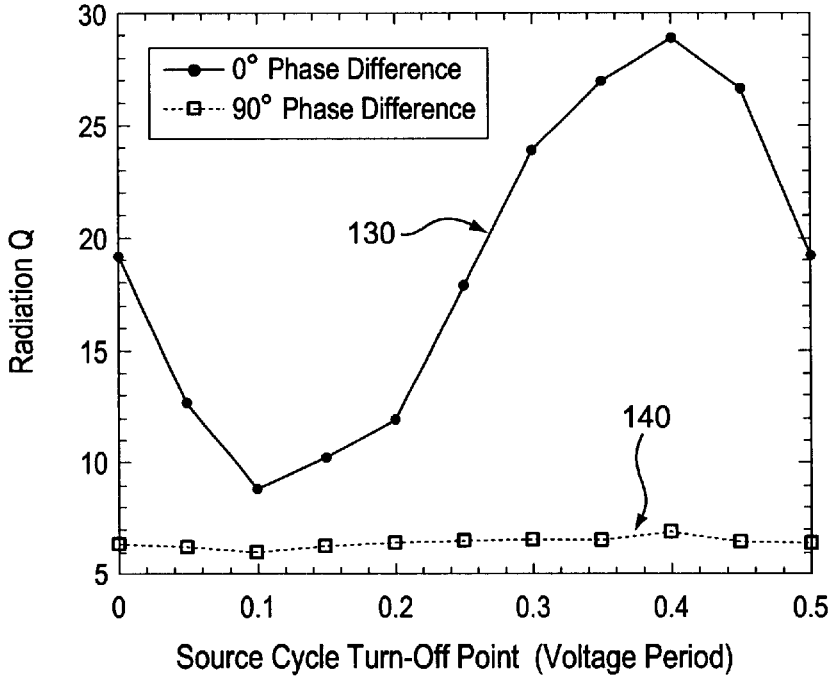
FIG. 6 has two graphical representations of Radiative Q as a function of source turn-off point, referenced to the input power minimum, for a set of dipole pairs such as that at 10

FIG. 6 graphically shows the FDTD-determined Q of an example radiator structure for which k*a=0.42 as a function of power/generator turn-off point, relative to the minimum input power point. As predicted, it was found that the source-associated standing energy is time-varying for all relative voltage phase differences except phase quadrature, i.e., 90°, when the dipole-pairs support circular polarization. As seen in FIG. 6, Radiative Q is independent of generator turn-off point when circular polarization is maintained (graph 140 is relatively flat for the phase quarature case). However, for other relative voltage phase differences, for example, here graph 130 is for a case when dipole pairs are in phase, i.e., 0°, Radiative Q varies with generator turn-off point. As indicated by Eq. (4) the correct value of Q is the largest value that is determined when the source-associated standing energy is at a maximum.

Figure 7:
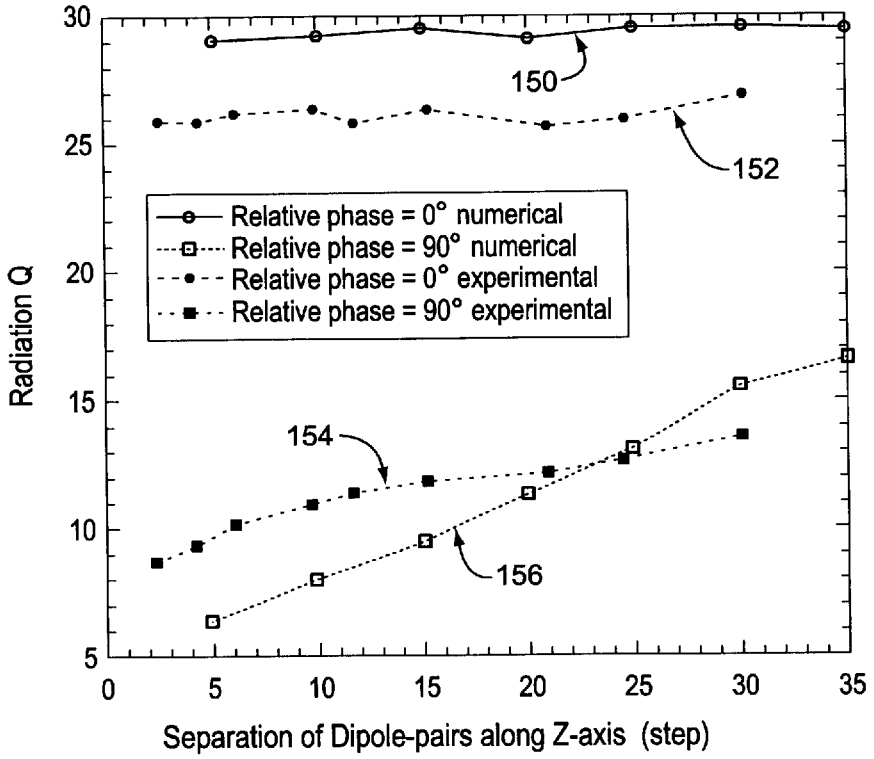
FIG. 7 has four graphical representations of Radiative Q as a function of spacing between collocated dipole pairs along the z-axis (indicated FIG. 1A); again, electrical size, k*a product, equal to 0.42.

To further characterize the operation of radiator structures of the invention, FIG. 7 illustrates what happens to Radiation/Radiative Q when, rather than being collocated as shown for reference in FIG. 1A, the source pairs are separated by a physical distance $D_z$ along the z-axis. Graphical representations at 154 and 156 (respectively, experimental results and numerically calculated), both of which are for the case with 90° relative voltage phasing between the dipole-pair elements, illustrate that Radiation Q is small for small $D_z$ values and increases with increasing values of $D_z$. Contrast with graphical representations 152 and 150 (respectively, experimental results and numerically calculated) when the four dipole elements of a preferred radiator structure of the invention are in-phase Radiation Q is approximately that of a single electric dipole of the same k*a, independent of $D_z$ value. Further experiments performed moving the dipole-pairs relative to each other in three dimensions supported this results: Generally, Radiative Q of a structure with 90° phased dipole-pairs is sensitive to relative location of the pairs, and Q of an in-phase dipole pair structure is not. FIG. 7 shows experimentally identified and computed Q versus relative spacing/step values ($D_z$) for a radiator structure with k*a of 0.42. Steps of 5 mm were taken in numerical models (see graphs 150 and 156), dimensions a=l/2=12 cm; and steps of 1.67 mm were taken in the experimental work (represented, here, by graphs 152 and 154), dimensions a=l/2=4 cm.

Figure 8:
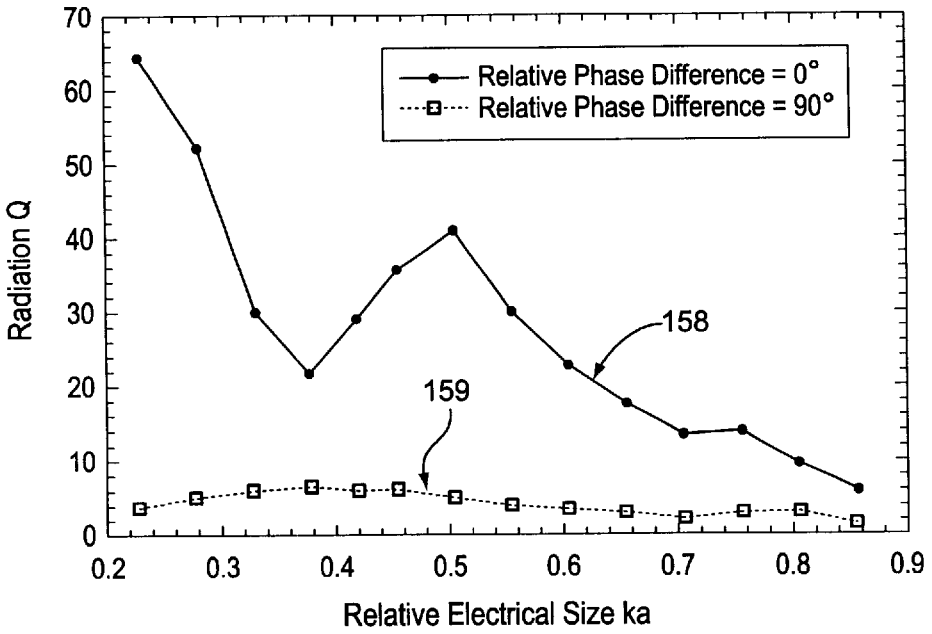
FIG. 8 has two graphical representations of numerically determined Radiative Q values as a function of electrical size, k*a. One graphical representation is for the case where there is a 90° relative phase difference between respective voltage across each of the dipole pairs (such as those at 12 and 14 in FIG. 1A) and the other graphical representation is for the case where respective voltage across each dipole pair is in-phase; with the dimension: a=l/2=12 cm (by way of example, only).

FIG. 8 graphically illustrates at 158, 159 numerically determined Q versus relative phasing between dipole-pairs and relative electrical size, k*a, of a radiator structure of the invention. Note that at k*a=0.23, Q for the circularly polarized structure (graph 159) is more than a factor of 20 below the predicted Chu (1948) limit for omnidirectional antennas. The in-phase results 158 confirm the $1/(ka)^3$ dependence of Q as the radiator structure becomes electrically small. Contrast with graph 159 for a structure having its two dipole-pairs phased to support circular polarization, Radiative/Radiation Q is relatively insensitive to frequency. As predicted, when circular polarization is maintained the radiator structure does not have to support, i.e. store in the near fields, large amounts of source-associated standing energy. Note further, the frequency response represented by graphs 158, 159 in FIG. 8 is indicative that the current and charge distributions on the dipole-pairs 'self-adjust' to support radiation fields that minimize source-associated standing energy, and hence Radiative Q. As one can see, graph 159 confirms the radiator structure characterized thereby demonstrates wideband operation.

Thus in the example case illustrated, the Radiative Q of a preferred radiator structure as configured with two dipole pairs, each having a TE and a TM element, depends upon the relative phasing between dipole pairs with a minimum Radiative Q value obtained when the dipole pairs are phased to support circular polarization (90° difference). Unlike known antenna structures, the measured and numerically determined Q values are well below, by at least an approximate factor of 20 (at for example, k*a=0.23), the limit established using long held known analytical techniques, e.g., Chu (1948), for electrically small omnidirectional antennas. Furthermore, when dipole pairs are in phase quadrature, or phased to support circular polarization, the antenna demonstrates wide-band operation.

Figure 9:
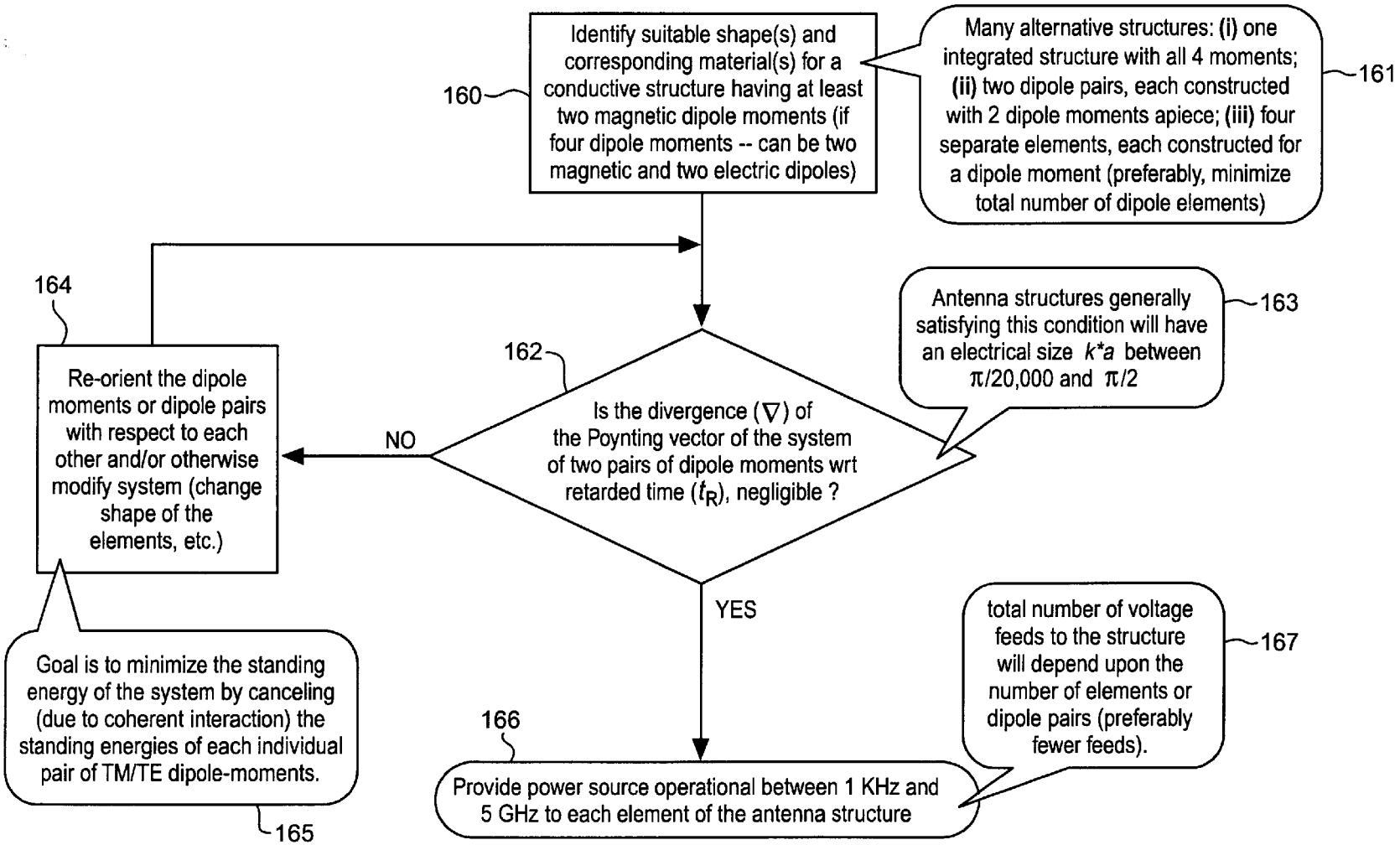
FIG. 9 is an illustrative flow diagram detailing basic steps of a preferred technique of producing an electrically small, low Q structure operational at lower frequencies as contemplated hereby.
Figure 10:
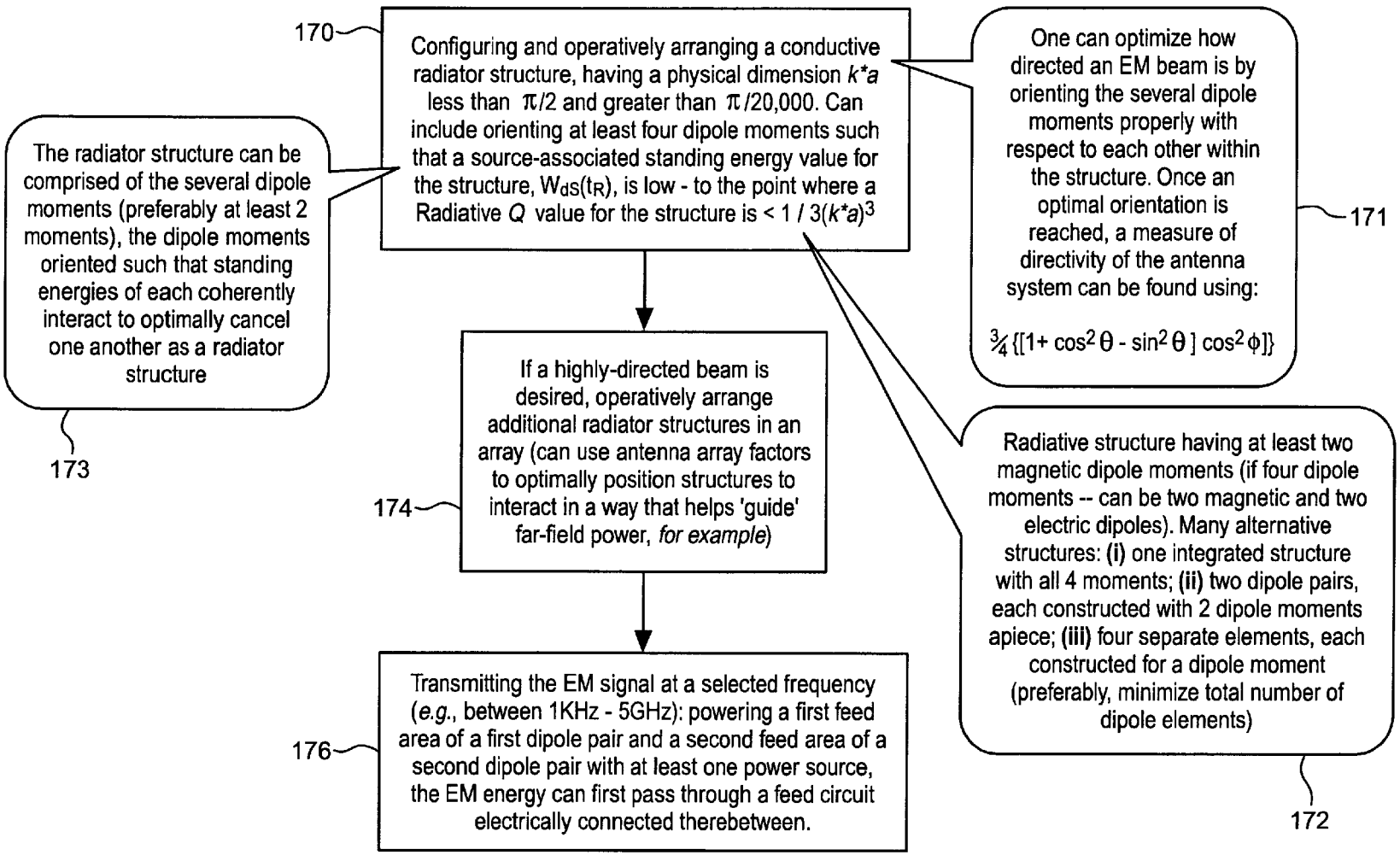
FIG. 10 is a flow diagram providing an overall view of a preferred method of producing EM waves of the invention.

Specific novel features and steps of the method of the invention, as characterized herein, are readily ascertainable from this detailed disclosure and as further represented in FIGS. 9 and 10. The flow diagram in FIG. 9 represents preferred features of the novel technique of producing radiator structures of the invention. Beginning with box 160, suitable overall shape(s), size limitations, and corresponding materials can be identified based upon the environment in which the radiator structure will operate. For example, if the environment is caustic or corrosive to metal alloy wiring or to etched microcircuits on or within a substrate, one might choose to build a radiator structure of the invention out of a membrane surrounding a conductive substance and voltage source therewithin, and so on. According to the analysis and design considerations set forth herein, many suitable alternative electrically small radiator structures can be identified. As indicated, for example, (box 160 and associated note 161) a few of the alternative radiative structures of the invention having at least two magnetic dipole moments, and if four dipole moments are constructed these can comprise two magnetic and two electric dipoles, follow: (i) one integrated structure configured capable of producing all four dipole moments; (ii) two dipole pairs, each constructed to produce two dipole moments apiece; (iii) four separate dipole elements, each constructed for a respective dipole moment, which could be electrically interconnected by suitable means or electrically insolated. If the design consideration referred to at 162 is not generally satisfied, namely, a divergence of the Poynting vector of the dipole moments with respect to retarded time, namely $\nabla|_{t_R}\cdot N$, has a small or negligible value, then the dipole elements can be re-oriented 164 such that they produce moments to satisfy this expression; where as noted at 165, the standing energy of the radiator structure is low or minimized. This takes place, for example, if the coherent interaction of the standing energies of elements generally cancel each other out. Further, since additional power sources can cause interference, it may be desired. to minimize the total number of independent and isolated dipole elements (notes 161 and 167) so that the structure requires fewer voltage feeds and/or power sources to operate.

The novel technique for producing electrically small low Q antennas, the radiator structures produced thereby, as well as the method of producing an EM signal, are applicable to arrays of low Q radiator structures arranged according to known antenna array factors to produce a system with a highly directed beam. In Chapter 3 of the text "Antenna Theory & Design" (1981), authors Warren Stutzman and Gary Thiele set forth generally accepted array factors which affect the directivity of radiation from an array of individual radiator structures. These so-called array factors include: (i) spacing of structures, (ii) phasing of structures, (iii) angles of structures, etc. In such an array, the directivity of the EM signal emitted from each radiator can be oriented such that the emission of the system is directed for high-strength, more-optimal transmission of energy. The applicants have identified a beam directivity expression describing the relationship between the power distribution relative to an isotropic spherical distribution for an individual structure of the invention (i.e., a measure of how directed an EM beam from the structure, is):

$$\text{beam directivity of radiator}=\tfrac{3}{4}\{[1+\cos^2\theta-\sin^2\theta]\cos 2\phi]\} \quad \text{Eq. (17)}$$

Turning to FIG. 10, a method of producing EM waves with a radiator structure of the invention as outlined, includes configuring and operatively arranging, box 170, a radiator structure preferably having a physical dimension k*a less than $\pi/2$ and greater than $\pi/20{,}000$. The method can include orienting respective elements producing at least four dipole moments such that a source-associated standing energy value for the structure, $W_{dS}(t_R)$, is low—to the point where a Radiative Q value for the structure is less than (<) $\frac{1}{3}(k^*a)^3$. Box 174 and note 171 point out that a highly directed EM beam may be desired, for example, in the case where the EM radiation must travel a great distance it is desirable to have far-field power optimally directed, and for medical applications low frequency arrays of radiator structures may more-optimally carry out the function of a medical device including one or more radiating structures of the invention. One can readily construct an array of the low Radiative Q radiator structures of the invention by arranging structures, as identified above, for more optimal operation. As noted in FIG. 9 Notes 172 and 173 once more confirm flexibility of the invention. Transmission of the EM signal, box 176, may be accomplished utilizing structure described (FIGS. 1A and 4).

Further distinguishing features of the methods detailed in FIGS. 9 and 10 are readily ascertainable from the description provided herein connection with a novel structure of the invention, the numerical analysis and experimentation follow-up performed using an identified preferred structure, as well as known and well understood techniques of fabricating antennas of a variety of shapes and sizes out of available, and yet to be discovered, suitable materials.

While certain representative embodiments and details have been shown merely for the purpose of illustrating the invention, those skilled in the art will readily appreciate that various modifications may be made without departing from the novel teachings or scope of this disclosure. Accordingly, all such modifications are intended to be included within the scope of this invention as defined in the following claims. Although the commonly employed preamble phrase "comprising the steps of" may be used herein, or hereafter, in a method claim, the Applicants in no way intends to invoke 35 U.S.C. Section 112 ¶6. Furthermore, in any claim that is filed herewith or hereafter, any means-plus-function clauses used, or later determined to be present, are intended to cover the structures described herein as performing the recited function and not only structural equivalents but also equivalent structures.

What is claimed is:

1. An electrically small radiator structure for radiating electromagnetic waves, comprising:

the structure having an electrical size, k*a, with a value between $\pi/20{,}000$ and $\pi/2$ and configured to have at least a first and second magnetic dipole element, wherein said electrical size, k*a, represents the expression $2\pi\cdot(a/\lambda)$, where $\lambda$ represents the wavelength of the radiating electromagnetic waves and a represents a radius of a circumscribing sphere around the radiator structure.

2. The radiator structure of claim 1 wherein said elements are oriented such that a source-associated standing energy value for the structure, $W_{dS}(t_R)$, is low; and each said element is connected through a feed circuit to at least one power source.

3. The radiator structure of claim 2 wherein said electrical size value is less than 0.5 and a Radiative Q value for the structure is less than $\frac{1}{3}(k^*a)^3$.

4. The radiator structure of claim 2 wherein: a first pair comprises a first electric dipole element in electrical communication with said first magnetic dipole element; a second pair comprises a second electric dipole element in electrical communication with said second magnetic dipole element; each said first and second pair are connected, through a feed circuit, to at least one power source; and said first pair is oriented orthogonally with respect to said second pair.

5. The radiator structure of claim 4 wherein: a first feed area of said first pair is separate from a second feed area of said second pair; a first voltage across said first pair and a second voltage across said second pair are in phase quadrature; and said feed circuit comprises a power splitter.

6. The radiator structure of claim 1 wherein the structure operates at a lower frequency range, said first and second magnetic dipole element each comprise a looped structure having a loop-plane; and further comprising a first electric dipole element oriented such that a length thereof is generally orthogonal with respect to said loop-plane of said first magnetic dipole element, a second electric dipole element oriented such that a length thereof is generally orthogonal with respect to said loop-plane of said second magnetic dipole element, and a power source to feed said first magnetic and electric dipole elements separately from said second magnetic and electric dipole elements.

7. The radiator structure of claim 1 further comprising a power source connected to each of said magnetic dipole elements, a first voltage across said first element and a second voltage across said second element having a relative voltage phase difference; and wherein a radiated power from each said magnetic dipole element is generally balanced.

8. The radiator structure of claim 1 wherein: a first dipole moment pair comprises said first magnetic dipole element and a first electric dipole moment; a second dipole moment pair comprises said second magnetic dipole element and a second electric dipole moment; and wherein said dipole moment pairs are oriented such that a divergence of the Poynting vector of said dipole pairs with respect to retarded time, namely $\nabla|_{t_R}\cdot N$, has a value less than 1.0; wherein N represents a Poynting vector for the radiator structure, the expression $t_R=t-\sigma/\omega$ represents a retarded time, t represents a time, $\omega$ represents a radian frequency, and $\sigma=k^*r$, where k represents the expression $2\pi/\lambda$ and r represents a radial distance from the radiator structure.

9. The radiator structure of claim 8 wherein said first magnetic dipole element comprises a loop oriented orthogonally with respect to a loop of said second magnetic dipole element; and a first voltage across said first dipole moment pair and a second voltage across said second dipole moment pair are in phase quadrature.

10. The radiator structure of claim 8 wherein a radiated power from each said dipole pair is generally balanced; a first voltage across said first dipole moment pair and a second voltage across said second dipole moment pair are in phase-quadrature; said first electric dipole moment is produced by a first element oriented such that a length thereof is generally orthogonal with a loop-plane of said first magnetic dipole element; and said second electric dipole moment is produced by a second element oriented such that a length thereof is generally orthogonal with a loop-plane of said second magnetic dipole element.

11. The radiator structure of claim 8 wherein: said first magnetic dipole element is oriented orthogonally with respect to said second magnetic dipole element; said first electric dipole moment is produced by a first element configured integrally with said first magnetic dipole element; said second electric dipole moment is produced by a second element configured integrally with said second magnetic dipole element; said first element is oriented orthogonally with respect to said second element.

12. An electrically small radiator structure for radiating electromagnetic waves, comprising:

the structure sized such that a is less than $\lambda/4$, where $\lambda$ represents the wavelength of the radiating electromagnetic waves and a represents a radius of a circumscribing sphere around the radiator structure, and having at least a first and second pair of dipole moments, each said pair comprising a magnetic dipole moment and an electric dipole moment; and said pairs of dipole moments oriented such that a divergence of the Poynting vector of said pairs with respect to retarded time, namely $\nabla|_{t_R}\cdot N$, has a value less than 1.0; wherein N represents a Poynting vector for the radiator structure, the expression $t_R=t-\sigma/\omega$ represents a retarded time, t represents a time, $\omega$ represents a radian frequency, and $\sigma=k^*r$, where k represents the expression $2\pi/\lambda$ and r represents a radial distance from the radiator structure.

13. The radiator structure of claim 12 wherein: the structure has an electrical size, k*a, with a value between $\pi/20{,}000$ and $\pi/2$, said electrical size, k*a, representing the expression $2\pi\cdot(a/\lambda)$; said first magnetic dipole moment and said first electric dipole moment of said first pair are oriented generally in parallel; and said first pair is oriented orthogonally with respect to said second pair.

14. The radiator structure of claim 13 wherein: a first voltage across said first dipole moment pair and a second voltage across said second dipole moment pair are in phase quadrature; each said first and second dipole moment pair are connected, through a feed circuit, to at least one power source; and the structure operates at a frequency between a range of 1 KHz and 5 GHz.

15. An electrically small radiator structure for radiating electromagnetic waves, comprising:

the structure having an electrical size, k*a, with a value less than $\pi/2$ and configured to have at least a first and second electric dipole element, wherein said electrical size, k*a, represents the expression $2\pi\cdot(a/\lambda)$, where $\lambda$ represents the wavelength of the radiating electromagnetic waves and a represents a radius of a circumscribing sphere around the radiator structure; and a first voltage across said first electric dipole element having a relative phase difference from a second voltage across said second electric dipole element.

16. The radiator structure of claim 15 wherein said relative phase difference is equal to 90°; said first element is oriented orthogonally with respect to said second element; and a radiated power from each said magnetic dipole element is generally balanced.

17. A method of producing electromagnetic waves using an electrically small radiator structure, comprising the steps of:

configuring the structure to have at least a first and second pair of dipole moments and an electrical size, k*a, with a value between $\pi/20{,}000$ and $\pi/2$, wherein said electrical size, k*a, represents the expression $2\pi\cdot(a/\lambda)$, where $\lambda$ represents the wavelength of the electromagnetic waves produced and a represents a radius of a circumscribing sphere around the radiator structure; and powering a first feed area of said first pair and a second feed area of said second pair with at least one source operating at a frequency to radiate the waves.

18. The method of claim 17 wherein said step of configuring further comprises orienting a first electric dipole element of said first pair with a first magnetic dipole element such that a dipole moment axis of said first electric dipole element is generally in parallel with a dipole moment axis of said first magnetic dipole element, orienting a second electric dipole element of said second pair with a second magnetic dipole element such that a dipole moment axis of said second electric dipole element is generally in parallel with a dipole moment axis of said second magnetic dipole element, and orienting said first pair orthogonally with respect to said second pair.

19. The method of claim 18 wherein:

said step of configuring further comprises forming a first conductive elongated member into said first magnetic and electric dipole elements, forming a second conductive elongated member into said second magnetic and electric dipole elements, electrically connecting said first and second magnetic dipole elements; and said step of powering further comprises generating electromagnetic energy with a single source and passing said energy through a feed circuit electrically connected to said first and second feed areas.

20. The method of claim 19 wherein: said step of forming said first conductive elongated member into said first magnetic dipole comprises forming a first loop, said step of forming said second conductive elongated member into said second magnetic dipole element comprises forming a second loop, said first and second loops are then electrically connected at a first and second point of contact; and a first voltage across said first pair and a second voltage across said second pair are in phase quadrature.

21. The method of claim 17 wherein:

said step of configuring further comprises orienting a dipole element formed for producing each moment of said first and second pair such that a divergence of the Poynting vector of said pairs with respect to retarded time, namely $\nabla|_{t_R}\cdot N$, has a value less than 1.0, wherein N represents a Poynting vector for the radiator structure, the expression $t_R=t-\sigma/\omega$ represents a retarded time, t represents a time, $\omega$ represents a radian frequency, and $\sigma=k^*r$, where k represents the expression $2\pi/\lambda$ and r represents a radial distance from the radiator structure; and the waves comprise a generally-directed electromagnetic beam.

22. A method of producing a generally-directed electromagnetic beam with an electrically small radiator structure, comprising the steps of:

configuring the structure to have at least four dipole moments at least two of which are produced, respectively, by a first and second magnetic dipole element; and orienting said dipole moments such that a divergence of the Poynting vector of said moments with respect to retarded time, namely $\nabla|_{t_R} \cdot N$, has a value less than 1.0; wherein N represents a Poynting vector for the radiator structure, the expression $t_R = t - \sigma/\omega$ represents a retarded time, t represents a time, $\omega$ represents a radian frequency, and $\sigma = k^* r$, where k represents the expression $2\pi/\lambda$ and r represents a radial distance from the radiator structure.

23. The method of claim 22 wherein: at least two other of said four dipole moments are produced, respectively, by a first and second electric dipole element; said step of configuring comprises forming a first dipole moment pair comprising said first magnetic dipole element and said first electric dipole element, and forming a second dipole moment pair comprising said second magnetic dipole element and said second electric dipole element; and further comprising the step of powering said first and second pair with at least one source operating at a frequency to radiate the beam.

24. The method of claim 23 wherein:

said step of forming said first and second dipole moment pairs further comprises orienting said pairs such that (a) a dipole moment axis of said first electric dipole element is generally in parallel with a dipole moment axis of said first magnetic dipole element, (b) a dipole moment axis of said second electric dipole element is generally in parallel with a dipole moment axis of said second magnetic dipole element, and (c) said first pair is orthogonal with respect to said second pair; and said step of powering further comprises generating electromagnetic energy with a single source and passing said energy through a feed circuit electrically connected to a first feed area of said first pair and a second feed area of said second pair.

25. The method of claim 24 wherein: said step of forming said first and second dipole moment pairs further comprises forming a first conductive elongated member into said first magnetic and electric dipole elements and forming a second conductive elongated member into said second magnetic and electric dipole elements such that the structure has an electrical size, $k^*a$, with a value between $\pi/20{,}000$ and $\pi/2$, wherein said electrical size, $k^*a$, represents the expression $2\pi \cdot (a/\lambda)$.

26. The method of claim 22 wherein said step of configuring comprises forming a first dipole moment pair comprising said first magnetic dipole element, forming a second dipole moment pair comprising said second magnetic dipole element, and orienting said first pair orthogonally with respect to said second pair; and wherein a first voltage across said first pair and a second voltage across said second pair are in phase quadrature; and further comprising the step of powering said first and second pair with at least one source operating at a frequency between a range of 1 KHz and 5 GHz.

27. A method of producing electromagnetic waves using an electrically small radiator structure, comprising the steps of:

configuring the structure to have at least a first and second electric dipole elements and an electrical size, $k^*a$, with a value less than $\pi/2$, wherein said electrical size, $k^*a$, represents the expression $2\pi \cdot (a/\lambda)$, where $\lambda$ represents the wavelength of the electromagnetic waves produced and a, represents a radius of a circumscribing sphere around the radiator structure; and powering a first feed area of said first element and a second feed area of said second element with at least one source such that a first voltage across said first element has a relative phase difference from a second voltage across said second element.

* * * * *